US005924484A

United States Patent [19]

Andersson et al.

[11] Patent Number: 5,924,484

[45] Date of Patent: Jul. 20, 1999

[54] PLATE HEAT EXCHANGER

[75] Inventors: Jarl A. Andersson, Lund; Jan-Ove Bergqvist, Malmo, both of Sweden

[73] Assignee: Alfa Laval Thermal AB, Lund, Sweden

[21] Appl. No.: 08/907,150

[22] Filed: Aug. 6, 1997

Related U.S. Application Data

[63] Continuation-in-part of application No. 08/571,890, filed as application No. PCT/SE94/00571, Jun. 13, 1994, abandoned.

[30] Foreign Application Priority Data

Jun. 17, 1993 [SE] Sweden ..... 9302136

[51] Int. Cl.[6] ..... F28F 3/08

[52] U.S. Cl. ..... 165/167; 165/178

[58] Field of Search ..... 165/167, 178

[56] References Cited

U.S. PATENT DOCUMENTS

| | | | |
|---|---|---|---|
| 2,075,236 | 3/1937 | Seligman et al. | 165/167 |
| 2,550,339 | 4/1951 | Ehrman | 165/167 |
| 4,407,359 | 10/1983 | Berger et al. . | |
| 4,470,455 | 9/1984 | Sacca . | |
| 4,660,633 | 4/1987 | Fischer | 165/167 |
| 5,203,406 | 4/1993 | Blomgren et al. . | |
| 5,443,115 | 8/1995 | Pederson et al. | 165/167 X |

FOREIGN PATENT DOCUMENTS

| | | | |
|---|---|---|---|
| 3600656 | 7/1987 | Germany | 165/167 |
| 127970 | 4/1950 | Sweden . | |

*Primary Examiner*—Leonard R. Leo
*Attorney, Agent, or Firm*—Fish & Richardson P.C.

[57] ABSTRACT

A plate heat exchanger includes a package of heat transfer plates. The heat transfer plates are provided with inlet ports therethrough forming an inlet channel through the package. A sealing means is arranged between the heat transfer plates and forms, together with the heat transfer plates, a first flow passage for one fluid in every second plate interspace and a second flow passage for a heating fluid in each of the remaining plate interspaces. The inlet channel communicates with each first flow passage through at least one inlet passage while being blocked from communication with each second flow passage by part of the sealing means located in a first sealing area that extends around the inlet channel. Every two adjacent heat transfer plates which delimit the first flow passage have an essentially tight surface abutment against each other in a second sealing area. The inlet passage is delimited by at least one of the two adjacent heat transfer plates between its inlet port and the first sealing area.

5 Claims, 3 Drawing Sheets

PLATE HEAT EXCHANGER

CROSS REFERENCE TO RELATED APPLICATIONS

This is a continuation-in-part of U.S. Ser. No. 08/571,890, now abandoned, which was filed on Apr. 12, 1996 and is incorporated herein by reference in its entirety, which is a 371 of PCT/SE94/00571, filed Jun. 3, 1994.

BACKGROUND OF THE INVENTION

The present invention relates generally to a plate heat exchanger.

Openable and permanently joined conventional plate heat exchangers are normally constructed with equally sized inlets and outlets for respective heat transfer media. For one-phase heat transfer, equally sized inlets and outlets are satisfactory with respect to flow velocity and pressure drop, since the specific volume for the media does not change considerably over the temperature range to which the media is exposed during the heat transfer.

In two-phase heat transfer, such as during concentration or evaporation, the media is supplied in liquid-phase and discharged in gas-phase, which has a considerably larger specific volume than the liquid-phase, wherein the flow velocity and the pressure drop in the outlet become larger than in the inlet. With equally sized inlets and outlets, imbalance may appear between different ducts in the plate heat exchanger.

According to one known plate heat exchanger, a restriction means is provided in respective inlets between two adjacent heat transfer plates to obtain an equal distribution of the incoming fluid. The restriction means may consist of a ring or a washer, which is provided with a hole and which is arranged between each pair of adjacent heat transfer plates. The restriction means can also consist of a pipe which has several holes and is arranged in the inlet port channel of the plate heat exchanger. As an alternative, the restriction means can be formed of the heat transfer plates themselves, whereby the edge of the ports of two adjacent heat transfer plates are folded edge to edge to each other except for a short distance, which forms an opening.

The aforementioned restriction means generally have not performed satisfactorily. Problems have arisen in the production of the plate heat exchanger. The use of separate rings or washers has proved far too expensive and it has been difficult to position the rings or the washers properly during assembly. A restriction means in the shape of a pipe must be adapted to the number of heat transfer plates included in the plate heat exchanger and also must be located correctly with respect to the inlet passages between the heat transfer plates. Thus, such pipes generally are not used in the serial production of plate heat exchangers. The proposed folding of the edge of the port has not proved practicable, because the heat transfer plates are made of thin plates and it is difficult to obtain a well-defined opening in the plate interspaces.

SUMMARY OF THE INVENTION

In general, according to one aspect, the invention features a plate heat exchanger including a package of heat transfer plates. The heat transfer plates are provided with inlet ports therethrough forming an inlet channel through the package. A sealing means is arranged between the heat transfer plates and forms, together with the heat transfer plates, a first flow passage for one fluid in every second plate interspace and a second flow passage for a heating fluid in each of the remaining plate interspaces. The inlet channel communicates with each first flow passage through at least one inlet passage while being blocked from communication with each second flow passage by part of the sealing means located in a first sealing area that extends around the inlet channel. Every two adjacent heat transfer plates which delimit the first flow passage have an essentially tight surface abutment against each other in a second sealing area. The inlet passage is delimited by at least one of the two adjacent heat transfer plates between its inlet port and the first sealing area.

Various implementations of the invention include one or more of the following features. The second sealing area can extend around the inlet channel and be situated between the inlet channel and the first sealing area. The inlet passage can be formed as one or more holes or ducts through at least one of the two adjacent heat transfer plates delimiting a the first flow passage. The second sealing area can have an extension around the inlet channel. Furthermore, the inlet passage can be located between the first sealing area and the second sealing area.

In various implementations, the invention includes one or more of the following advantages. A well-defined opening can be attained to restrict the incoming fluid. In addition, the heat transfer plates and the entire plate heat exchanger can be formed at a low production and assembly costs. The need for extra components can also be eliminated. By integrating the restriction means in the pattern of the plate, the shape can be altered depending on the need of restriction.

A heat transfer plate designed according to the invention can be used for purposes other than evaporation. For example, by cutting a port with a larger diameter, a conventional heat transfer plate is obtained without any restriction means. It is thus possible to cut existing pressing tools such that the major part of known heat transfer plates may be utilized either for evaporation or for conventional one-phase heat transfer by simply cutting the plates. It is not necessary to produce additional pressing tools for pressing heat transfer plates intended for evaporation. The additional cost for production of such plates is relatively low.

Additional features and advantages of the invention will be apparent from the drawings, description of the preferred embodiments and the claims.

DESCRIPTION OF THE PREFERRED EMBODIMENTS

Figure 1:
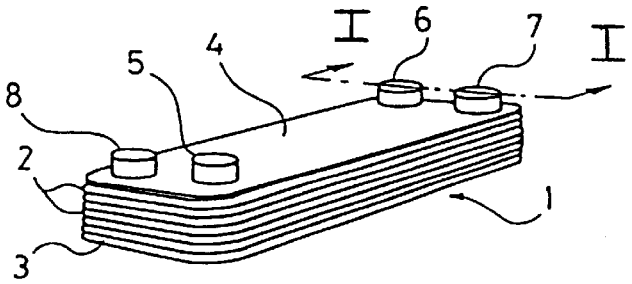
FIG. 1 is a perspective view of a plate heat exchanger.

In FIG. 1, a plate heat exchanger 1 includes a package of heat transfer plates 2 and outer cover plates 3 and 4 which are arranged on the under and the upper side, respectively, of the package. The plate heat exchanger 1 has a first and a second inlet 5 and 6 and a first and a second outlet 7 and 8 for two heat transfer media.

Figure 2:
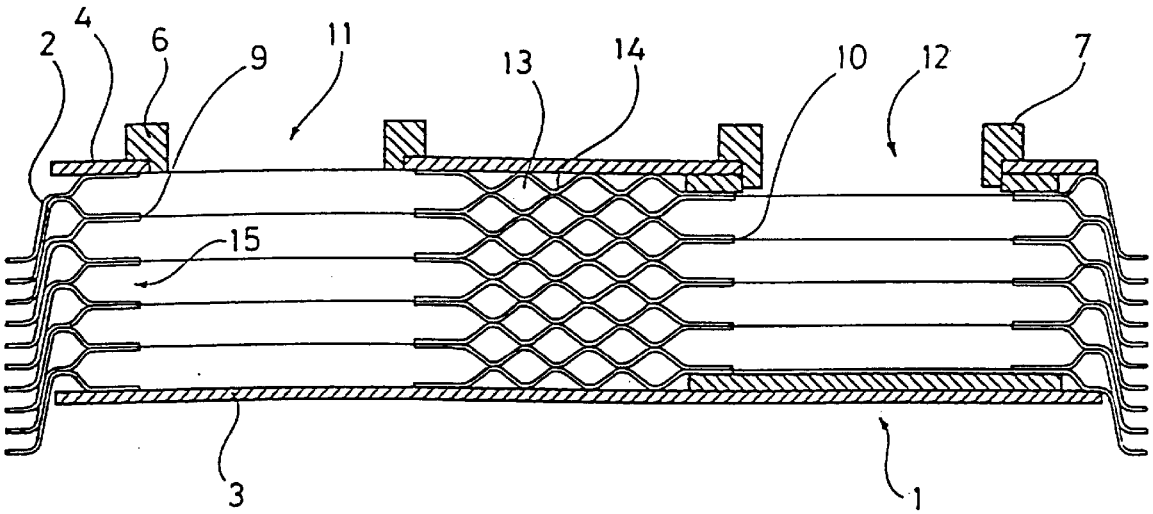
FIG. 2 shows a cross-section through a conventional plate heat exchanger along the line I—I in FIG. 1.

In FIG. 2 a cross-section through the plate heat exchanger of FIG. 1 is shown, extending along the part of the heat exchanger comprising the second inlet pipe 6 and the first outlet pipe 7.

The plate heat exchanger 1 includes ten heat transfer plates 2, which are arranged on top of each other between the upper, outer cover plate 4 and the lower, outer cover plate 3. The number of heat transfer plates 2 of the heat exchanger can be altered with respect to a desired capacity.

The heat transfer plates 2 are provided with through ports 9 and 10. The ports 9 and 10 are located in line with each other, such that the ports 9 form an inlet channel 11 through the package and the ports 10 form an outlet channel 12 through the package. Both of the ducts are delimited below by the cover plate 3. The inlet channel 11 is connected to the inlet pipe 6, and the outlet channel 12 is connected to the outlet pipe 7.

The plate heat exchanger 1 is provided with sealing means between the heat transfer plates 2. Together with respective heat transfer plates in every other plate interspace, the sealing means delimit a first flow passage 13 for one fluid and in the remaining plate interspaces delimit second flow passages for a heating fluid.

The heat transfer plates 2 are preferably provided with a corrugation pattern in the shape of parallel ridges 14, which are arranged such that the opposing ridges of adjacent heat transfer plates 2 cross and abut each other.

The first flow passage 13 is connected to the inlet channel 11 by way of at least one inlet passage 15 between the ports 9 of two adjacent heat transfer plates 2.

The plate heat exchanger includes rectangular heat transfer plates 2. Other shapes can also be used, such as rounded heat transfer plates.

The plate heat exchanger is provided with one inlet channel 11 and one outlet channel 12 for each of the two heat transfer media. The inlet and outlet channels are located in the end portions of the heat transfer plates 2. A plate heat exchanger can be provided with several inlet or outlet channels, and the shape and location of the channels can be freely chosen.

The plate heat exchanger can either be openable or permanently joined by means of soldering, gluing or welding. When joined by means of soldering, a suitable number of heat transfer plates are stacked on each other with a solder in shape of a thin sheet located between adjacent heat transfer plates, whereupon the whole package is heated in an oven until the solder melts.

During the assembly of openable plate heat exchangers, a suitable number of plates are stacked on each other with sealing means, in the shape of rubber gaskets or the like, located between adjacent plates. The whole package is clamped together with the aid of bolts (not shown) or the like.

Figure 3:
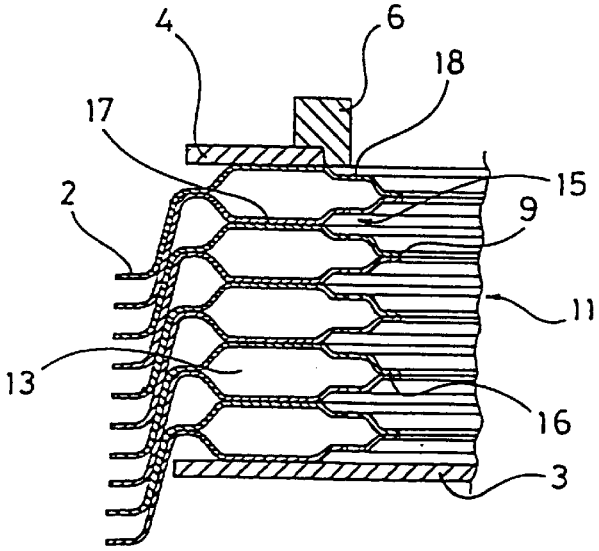
FIG. 3 shows a partial cross-section through a plate heat exchanger according to a first embodiment of the invention along the line I—I in FIG. 1.

In FIG. 3, which illustrates a first embodiment of the invention, the heat transfer plates 2 are provided with a contracted inlet channel 11 for the fluid compared with what is shown in FIG. 2. The port 9 has a smaller diameter, and the plate material around the port 9 is formed such that the heat transfer plates 2 abut closely towards each other along the edge of the port 9.

The heat transfer plates 2 have a first outer sealing area 17 and a second inner sealing area 16, which close respective second and first flow passages. The second sealing area 16 has an extension around the inlet ports 9 and in directions crossing the inlet channel 11. This second sealing area 16 can also extend around the inlet ports 9 and in a direction along the inlet channel 11. In any case, the heat transfer plates 2 abut against each other by surface to surface abutment in the second sealing area 16.

To achieve a communication between the first flow passage 13 and the inlet channel 11, respective inlet passages 15 are formed as one or more holes 18 through the heat transfer plates 2. The number of holes 18 and their size can be adapted to a desired restriction of the inlet passage 15. The holes 18 can be arranged in one or in both of two adjacent heat transfer plates 2. The distribution of the holes 18 around the port 9 can be varied depending on the desired flow properties. The distribution in different plate interspaces along the plate heat exchanger can be varied as well.

It is possible to choose an appropriate size for the holes 18 and, thereby, achieve a well-defined inlet passage for restriction of the incoming medium. The inlet passage 15 is delimited by at least one of the heat transfer plates 2 between the first sealing area 17 and the inlet port 9 of the heat transfer plate 2.

The heat transfer plates 2 of the plate heat exchanger 1 are formed such that the restriction is integrated with the plates, and the cost of production and assembly of the plate heat exchanger is low.

Figure 4:
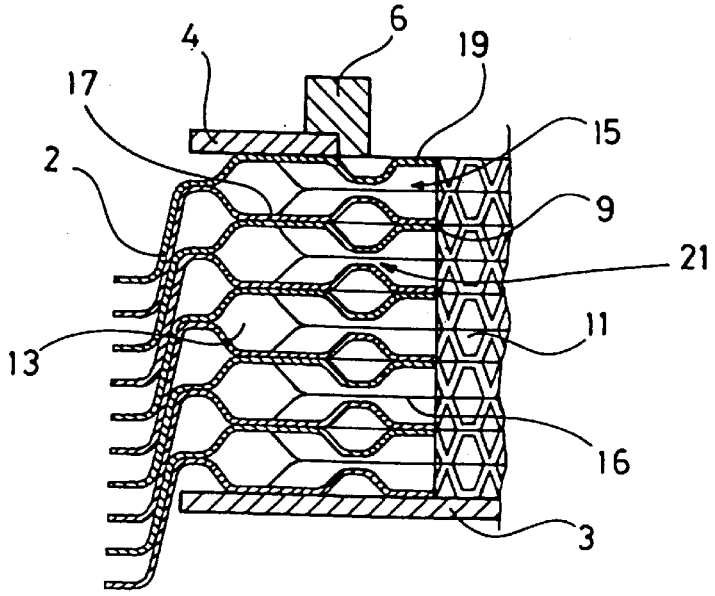
FIG. 4 shows a partial cross-section through a plate heat exchanger according to a second embodiment of the invention along the line IV—IV in FIG. 5.
Figure 5:
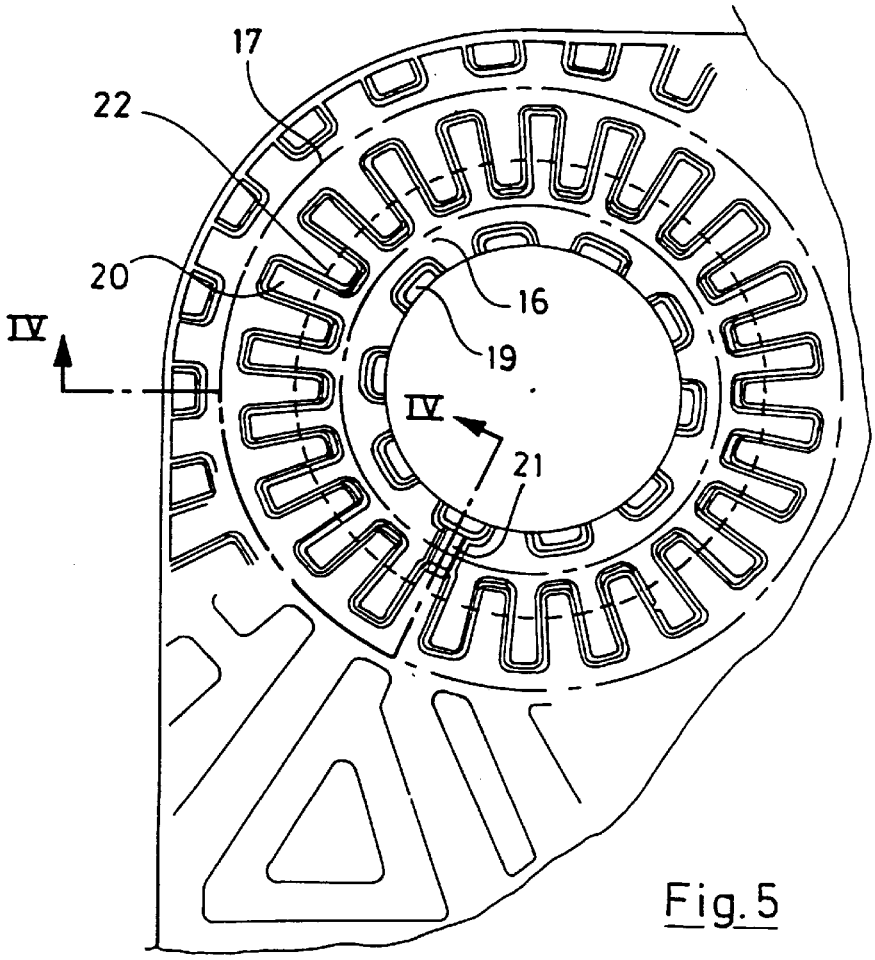
FIG. 5 shows part of a heat transfer plate included in the plate heat exchanger according to FIG. 4.

FIGS. 4 and 5 show a second embodiment of the invention in which the heat transfer plates 2 are provided with a contraction of the inlet channel 11 for the fluid, compared with what is shown in FIG. 2. An essentially flat annular second sealing area 16 and a first sealing area 17 are provided around the port 9 where the heat transfer plates 2 abut closely against each other.

A number of projections 19 are provided within the second sealing area 16 and a number of projections 20 are provided outside the sealing area 16. The projections 19 and 20 extend from one lower end plane to an upper end plane of the heat transfer plates 2. The projections 19 and 20 of one plate abut towards the projections 19 and 20 of an adjacent plate. The projections abutting towards each other form uniting means, holding the port portions of the two heat transfer plates together along the inlet channel 11.

As illustrated in FIGS. 4–5, at least one duct or channel 21 is connected to the first flow passage 13 between opposing pairs of heat transfer plates 2 and between the projections 19 and 20. The channel 21 is formed by a projection of the plate in the second sealing area 16. This projection can be formed such that the channel 21 discharges into the projection 19, but it can also discharge between two adjacent projections 19. One such channel 21 can also be formed in the heat transfer plates of the kind appearing in FIG. 3.

The bottom of the channel 21 is located between the lower end plane and the upper end plane of the heat transfer plates 2. The size of the channel 21 can be adapted to a desired restriction of the inlet passage 15 by varying the position of its bottom or by varying its width.

The channel 21 can be arranged in one or in both of two adjacent heat transfer plates 2. The number of ducts 21 and their distribution can be arranged in the same way as described above in connection with FIG. 3.

In FIG. 5, a dashed line 22 is also shown along which the port 9 of the heat transfer plate 2 may be cut or punched to obtain a conventional heat transfer plate.

Figure 6:
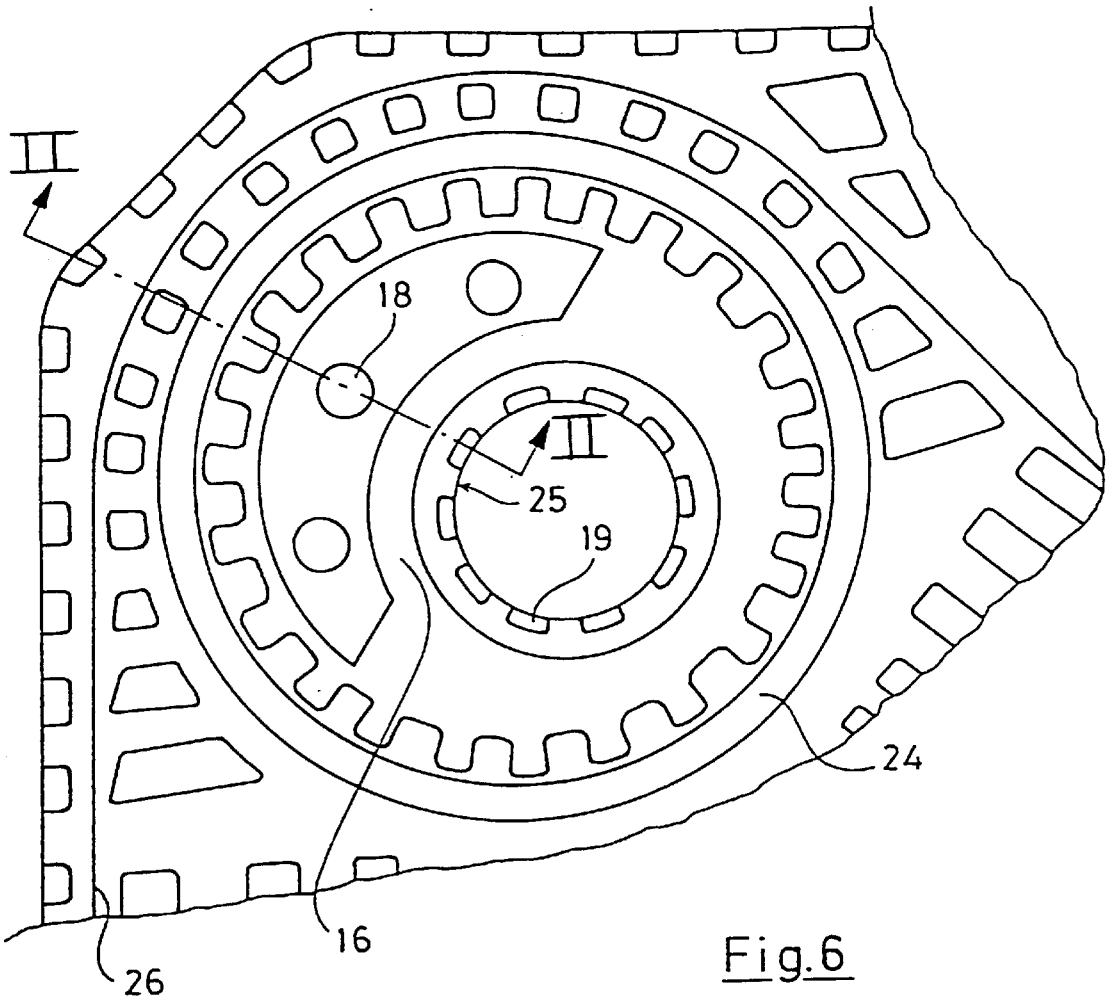
FIG. 6 shows part of a heat transfer plate included in an additional embodiment of a plate heat exchanger according to the invention.
Figure 7:
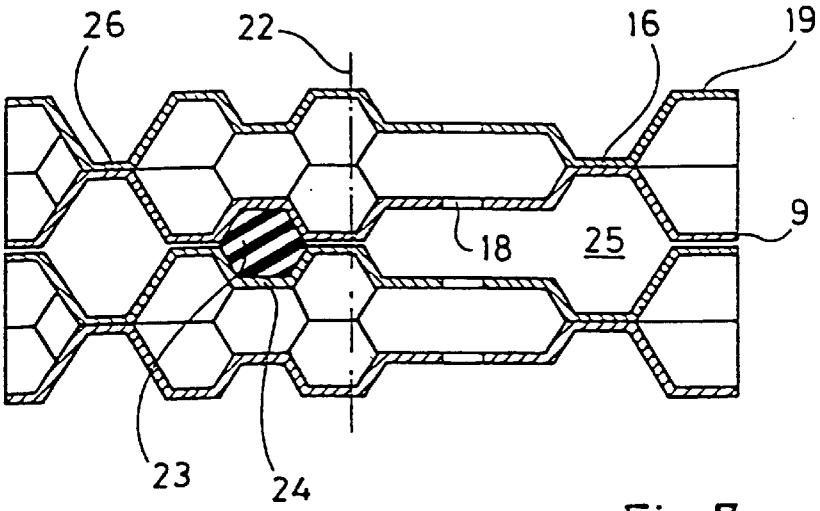
FIG. 7 shows a cross-section along the line II—II in FIG. 6.

In FIGS. 6 and 7 a further embodiment of the invention is shown, which is intended for a partly openable plate heat exchanger including a welded joint along the second sealing area 16 and a rubber gasket 23 between two adjacent pairs of welded heat transfer plates. The rubber gasket 23 is located in one gasket groove 24 around the port 9, corresponding to the previously mentioned first sealing area.

An inlet passage is provided by the combination of the holes 18 and a channel 25 between the projections 19. The welded pair of heat transfer plates have a further welded joint along a sealing area 26 located toward the outer edge of the plates. These heat transfer plates can also be cut or punched along the line 22 to obtain conventional heat transfer plates.

Other implementations are contemplated within the scope of the claims.

What is claimed is:

1. A plate heat exchanger comprising a package of heat transfer plates which are provided with inlet ports therethrough forming an inlet channel through the package, and sealing means arranged between the heat transfer plates and forming together with the heat transfer plates a first flow passage for one fluid in every second plate interspace and a second flow passage for a heating fluid in each of the remaining plate interspaces, wherein the inlet channel communicates with each first flow passage through at least one inlet passage while being blocked from communication with each second flow passage by part of the sealing means located in a first sealing area that extends around the inlet channel, and further wherein every two adjacent heat transfer plates delimiting a first flow passage have an essentially tight surface abutment against each other in a second sealing area, that extends around the inlet channel and is situated between the inlet channel and the first sealing area, and wherein the inlet passage is delimited by at least one of the two adjacent heat transfer plates between its inlet port and the first sealing area.

2. A plate heat exchanger according to claim 1, wherein the inlet passage is formed as one or more holes through at least one of the two adjacent heat transfer plates delimiting the first flow passage.

3. A plate heat exchanger according to claim 1, wherein the inlet passage is formed as one or more ducts extending through the second sealing area between the two adjacent heat transfer plates delimiting the first flow passage.

4. A plate heat exchanger according to any one of the preceding claims, wherein the second sealing area has an extension around and across the inlet channel.

5. A plate heat exchanger according to claim 1, wherein the inlet passage is located between the first sealing area and the second sealing area.

* * * * *